US007712272B2

(12) United States Patent
Long, Sr.

(10) Patent No.: US 7,712,272 B2
(45) Date of Patent: May 11, 2010

(54) SYMMETRICAL LOAD TRANSFER DEVICE FOR INSULATED CONCRETE SANDWICH WALL PANELS

(75) Inventor: Robert T. Long, Sr., Ames, IA (US)

(73) Assignee: Composite Technologies Corporation, Boone, IA (US)

( * ) Notice: Subject to any disclaimer, the term of this patent is extended or adjusted under 35 U.S.C. 154(b) by 321 days.

(21) Appl. No.: 11/581,642

(22) Filed: Oct. 16, 2006

(65) Prior Publication Data

US 2007/0107375 A1 May 17, 2007

Related U.S. Application Data

(60) Provisional application No. 60/727,160, filed on Oct. 14, 2005.

(51) Int. Cl.
*E04B 2/28* (2006.01)

(52) U.S. Cl. ..... 52/309.11; 52/378; 52/383

(58) Field of Classification Search ..... 52/378, 52/379, 383, 309.11, 309.9, 309.12, 309.14, 52/309.17, 426, 396.02, 396.04, 396.05, 52/396.08

See application file for complete search history.

(56) References Cited

U.S. PATENT DOCUMENTS 2,133,752 A * 10/1938 Myer et al. ..... 81/485
3,996,713 A * 12/1976 Haeussler ..... 52/309.12
4,394,201 A * 7/1983 Haeussler ..... 156/73.6
4,598,519 A * 7/1986 Reid ..... 52/426
5,809,725 A * 9/1998 Cretti ..... 52/426
6,088,985 A * 7/2000 Clark ..... 52/309.11
6,276,104 B1 * 8/2001 Long et al. ..... 52/309.4
6,532,714 B1 * 3/2003 Ferm et al. ..... 52/742.12
6,761,007 B2 * 7/2004 Lancelot et al. ..... 52/426
2003/0115831 A1 * 6/2003 Long, Sr. ..... 52/786.13
2004/0011943 A1 * 1/2004 Long, Sr. ..... 249/216

* cited by examiner

*Primary Examiner*—Brian E Glessner
*Assistant Examiner*—Adriana Figueroa
(74) *Attorney, Agent, or Firm*—Kent A. Herink; Emily E. Harris

(57) ABSTRACT

A symmetrical load transfer device for use in insulated concrete wall panels. The symmetrical shape allows for forces induced in manufacturing, transportation, installation and nature to transfer through the device equally to both concrete wythes of the wall panel. The load transfer device is preferably made of a thermoplastic or thermoset resin matrix incorporating continuous filaments, such as glass rovings. The low thermal conductivity of the matrix of filaments and resins greatly reduce thermal bridging of the insulation layer while maintaining structural integrity of the wall panel.

4 Claims, 2 Drawing Sheets

SYMMETRICAL LOAD TRANSFER DEVICE FOR INSULATED CONCRETE SANDWICH WALL PANELS

This application claims priority to U.S. Patent Application Ser. No. 60/727,160, filed Oct. 14, 2005.

BACKGROUND OF THE INVENTION

The invention relates generally to connector systems for insulated concrete wall panels and, more specifically, to a symmetrical load transfer connector for use in precast insulated concrete wall panels.

Precast insulated concrete wall panels are well known in the art and offer a number of advantages for residential and commercial building construction. These advantages include shorter construction schedules, improved thermal resistance, improved quality control, and enhanced durability. However, conventional concrete wall panels are heavy, thus increasing the cost of transporting the panels from the precasting plant to the job site. The large weight of the panels often times requires multiple loads to be delivered to the job site, thereby resulting in potential delays during loading, transportation, and unloading. The large weight also requires the use of an expensive, heavy crane for panel installation.

Insulated concrete wall panels may include inner and outer concrete layers, or wythes, with an internal insulation layer provided between the concrete layers, so as to be lighter weight than solid walls of the same thickness. The prior art concrete wall panels are typically constructed using metallic connectors with high thermal conductivities. Plastic connectors have been used to reduce thermal bridging and problems with corrosion of the metallic connectors, but have problems due to long-term creep and quality due to manufacturing processes. Another connector system uses transverse layers of fiber rovings. However, these connectors result in weak points in the wall panels and are subject to inner laminar shear resulting in brittle failure of the connection system.

To improve the composite character of insulated wall panels, while avoiding the solid concrete sections and metallic connectors which created thermal bridges across the wythes and reduce the insulation factor of the panels, connectors made of high-strength composite materials, such as resin-boded glass fibers, have come into use. These materials do not suffer from the long-term creep of plastic connectors and are resistant to the laminar shear that causes failure of the layered roving connectors.

The connector of the present invention has low thermal conductivity to prevent thermal bridging and is of a symmetric shape which allows the formed wall panels to resist forces induced during manufacturing, transportation and installation of the wall panel and environmental forces induced on the wall panel after installation.

Accordingly, a primary objective of the present invention is the provision of an improved connector system for insulated concrete wall panels.

Another objective of the present invention is the provision of an improved concrete wall panel.

A further objective of the present invention is the provision of a symmetrical insulating connector for interconnecting two or more concrete layers of a concrete panel and which is adjustable to accommodate sandwiched insulation layers of a range of thicknesses.

These and other objectives become apparent from the following description of the invention.

SUMMARY OF THE INVENTION

The connectors of the present invention consist of a symmetrical connector formed of a high-strength insulating material for use in the construction of insulated concrete sandwich wall panels for use in commercial, industrial, residential and agricultural applications. The connector is preferably formed of a low conductive matrix of filaments bonded together using resins. One portion of the connector is consolidated in a first of the concrete wythes of the wall panel and a second, generally opposite portion of the connector is consolidated in a second concrete wythe. A placement plate assists in the location of the connector during manufacture of the concrete wall panel by providing a surface that is placed against one of the wythes. In the preferred embodiment, the placement plate is adjustable in the field to the desired position and then secured prior to use in the concrete wall panel. While the connector may be of any symmetrical shape, a circular symmetry is preferred.

DETAILED DESCRIPTION OF THE PREFERRED EMBODIMENTS

Figure 1:
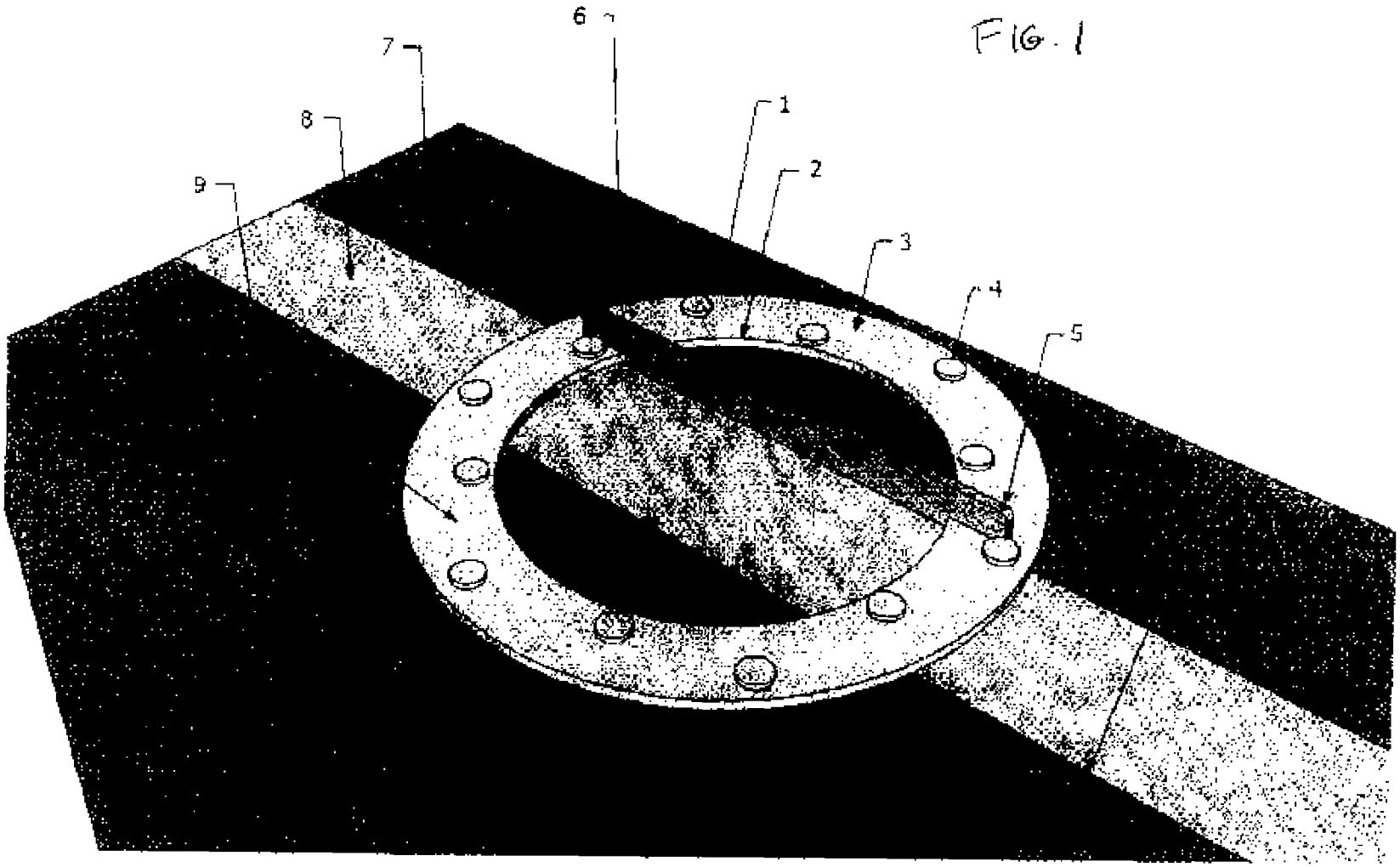
FIG. 1 is a perspective view showing a section of an insulated concrete wall panel in which a connector according to the present invention is in use interconnecting the two layers of concrete.

Illustrated in FIG. 1, generally at 3, is a preferred embodiment of the symmetrical connector of the present invention, comprising an annular ring with an outer perimeter 1 and an inner perimeter 2. The connector 3 is used in the manufacture of an insulated concrete sandwich wall panel that has been sectioned through the position of the connector 3 for illustrative purposes in FIG. 1. The annular connector 3 is consolidated during manufacture of a concrete sandwich wall panel in the concrete wythes 7 and 9, spanning the sandwiched insulation 8.

Figure 2:
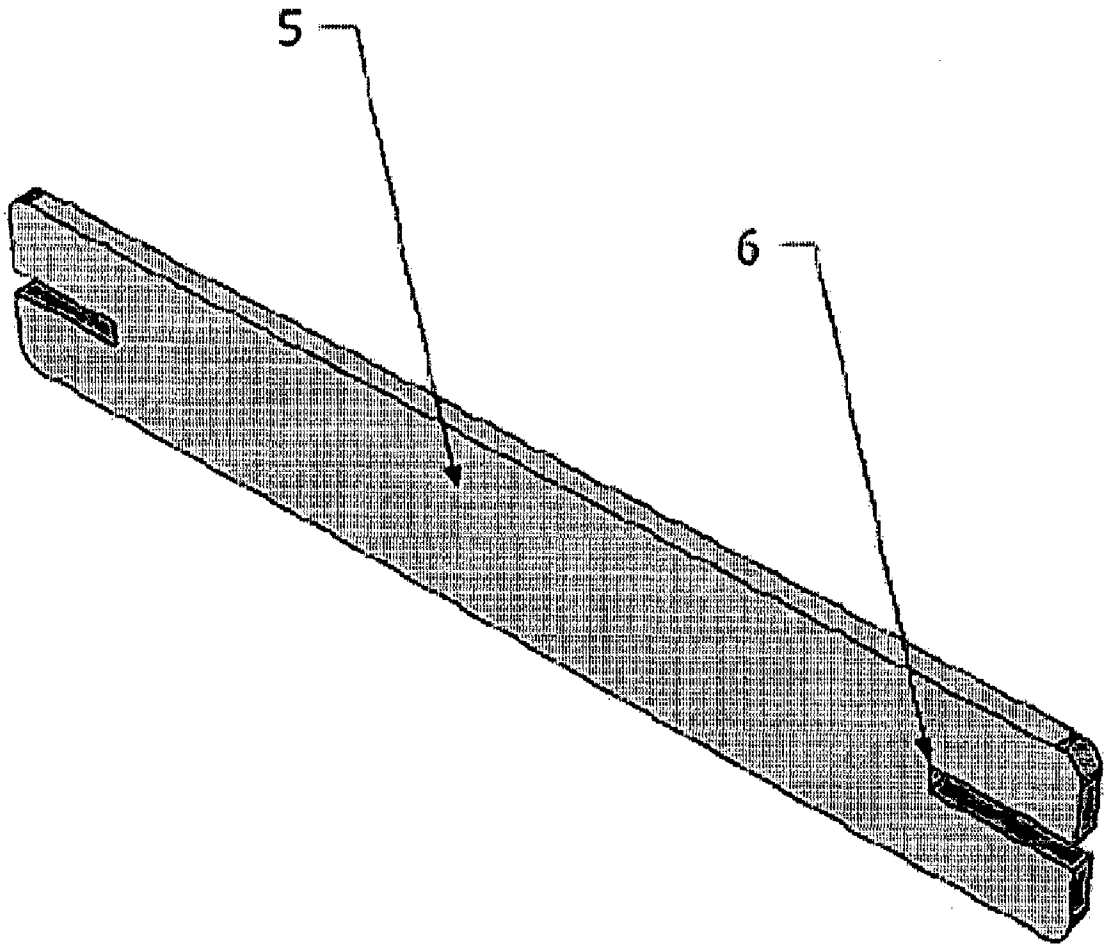
FIG. 2 is a perspective view of a placement plate of the present invention.

A placement plate 5 (FIGS. 1 and 2) is provided as a part of the annular connector 3. The placement plate 5 has a longitudinal slot 6 formed in each end portion. The slots 6 are sized to be slightly wider than the thickness between side A and side B of the annular connector 3. In use, the placement plate 5 is flexed about its central region to reduce its effective length and positioned inside the inner perimeter 2 of the annular connector 3. It is then allowed to relax to its original planar configuration with a portion of the annular connector 3 inside each of the slots 6 (FIG. 1). The placement plate 5 is slidably moveable inside the inner perimeter 2 to a desired adjusted position relative to a diameter of the annular connector 3 and is preferably fixed at the adjusted position by glue, thermal weldments, or the like.

A plurality of anti-rotational features 4 are provided on both sides A and B of the annular connector 3. In the preferred embodiment, the anti-rotational features 4 are raised lug sections extend above the surfaces A and B of the annular connector 3, but they may also be depressions, holes, or the like. The anti-rotational features 4 assist in the consolidation of the annular connector 3 in the concrete of the wythes 7 and 9 during manufacture of the wall panel and prevent movement of the annular connector 3 both in a rotational direction about the axis of the connector and in a transverse or radial direction.

The connector 3 of the preferred embodiment has a circular symmetry, but any bilateral symmetry can be used. Symmetry of the load transfer connector allows for equal or nearly equal transfer of compression, shear, and tension forces. The preferred connector 3 also has a constant thickness, but the scope of the present invention includes connectors having varying thicknesses, and varying the thickness of the connector 3 may also provide an anti-rotational and anti-transational feature or aspect to the connector 3 similarly to the features 4.

The connector 3 is preferably fabricated of a thermoset or thermoplastic matrix reinforced with continuous filaments including but not limited to glass, carbon, aramid and hybrids of such fibers or filaments. The continuous filament matrix allows the load present in one of the concrete wythes to transfer through the connector to the other concrete wythe, thereby giving a composite character to the wall panel. The connector is thus able to transfer tension, compression and shear forces. Such matrices have low thermal conductivity and thus reduce energy loss through the wall panel when compared to the conventional solid concrete sections or metallic connectors.

In the preferred method of constructing a concrete wall panel using the connectors system of the present invention, a first concrete wythe is formed and the sheet of insulation is placed on top of it while the concrete is still plastic. The placement plate of the connector system is positioned so that the panel is approximately one-half of the thickness of the insulation sheet away from a diameter or axis of symmetry of the connector and farther from an insertion edge portion of the connector. The connector is oriented generally perpendicular to the insulation and the insertion end portion of the connector is then pushed through the insulation until the placement plate comes into flush contact engagement with the insulation sheet. The insertion edge portion of the connector is thereby extending into the plastic concrete wythe. The second concrete wythe is then poured on top of the insulation sheet and the plurality of connectors, thus consolidating the connectors and the placement plates in the concrete wythes. If rigid insulation is used, it creates surface friction with the placement plate and improves the capacity of the symmetrical load transfer connector. Upon hardening or curing of the concrete wythes, the symmetrical connectors of the present invention create a wall panel having either partial or total composite characteristics.

The preferred embodiment of the present invention has been set forth in the drawings and specification. Although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

I claim:

1. A connector system for use in forming concrete sandwich wall panels having a pair of spaced-apart concrete wythes with an insulation layer therebetween, comprising:

(a) a planar circular connector member having bilateral symmetry having a circumferential edge portion consolidated in a first concrete wythe and a diametrically opposite circumferential edge portion consolidated in the second concrete wythe with the bilateral axis of symmetry aligned parallel with the concrete wythes; and (b) features on the connector member which improve the consolidation of the connector member in the concrete wythes;

a planar spacer secured at an adjusted position on the connector for positioning the connector substantially equally within the concrete wythes with the spacer adjacent to both the insulating layer and one of the concrete wythes.

2. A connector system as defined in claim 1, wherein the spacer comprises a plate.

3. A connector system as defined in claim 1, wherein the connector member has circular symmetry.

4. A connector system as defined in claim 1, wherein the connector member is comprised of a thermoplastic or thermoset matrix reinforced with substantially continuous filaments.

* * * * *